US006591600B2

(12) United States Patent
Ludvíček et al.

(10) Patent No.: US 6,591,600 B2
(45) Date of Patent: Jul. 15, 2003

(54) ROTOR SPINNING MACHINE

(75) Inventors: Josef Ludvíček, Čs. armády (CZ); Pavel Kousalik, Třebovská (CZ); Jaroslav Markl, Chodská (CZ); Tomáš Tesař, Wolkerova (CZ)

(73) Assignee: Rieter CZ A.S., Usti nad Orlici (CZ)

( * ) Notice: Subject to any disclaimer, the term of this patent is extended or adjusted under 35 U.S.C. 154(b) by 0 days.

(21) Appl. No.: 09/911,864

(22) Filed: Jul. 24, 2001

(65) Prior Publication Data

US 2002/0073686 A1 Jun. 20, 2002

(30) Foreign Application Priority Data

Jul. 26, 2000 (CZ) ..... PV 2000-2736

(51) Int. Cl.[7] ..... D01H 4/08
(52) U.S. Cl. ..... 57/408; 57/400; 57/404
(58) Field of Search ..... 19/109; 57/263, 57/300, 302, 304, 400, 404, 406, 407, 408, 409, 411, 412, 413, 414

(56) References Cited

U.S. PATENT DOCUMENTS 4,202,163 A * 5/1980 Turk et al. ..... 19/105
4,249,370 A * 2/1981 Vecera et al. ..... 57/301
5,640,839 A * 6/1997 Novotny et al. ..... 57/263

* cited by examiner

*Primary Examiner*—John J. Calvert
*Assistant Examiner*—Shaun R Hurley
(74) *Attorney, Agent, or Firm*—Dority & Manning

(57) ABSTRACT

The invention relates to a rotor spinning machine comprising a plurality of operating units situated next to each other, each of which contains a spinning unit (1) with a singling-out device (5) having in its body a rotatably mounted combing roller (52) equipped on its circumferential surface with an operative coating (521) around which there is provided in the body (51) of the singling-out device a circumferential fibre channel (511) whose operative section extends in the sense of rotation of the combing roller (52) from the mouth of the sliver feeding device (4) to the supply channel (6) bringing the singled-out fibres into the rotor, said circumferential fibre channel (511) having provided therein the mouth of a closable auxiliary supply channel (514) for pressure air. The closable auxiliary supply channel (514) of pressure air of each spinning unit (1) is connected to the outlet (531) of a closable means (53) related thereto whose inlet (532) is by a pressure air pipe 9) connected to a pressure air source (10).

17 Claims, 3 Drawing Sheets

ROTOR SPINNING MACHINE

TECHNICAL FIELD

The invention relates to a rotor spinning machine comprising a plurality of operating units situated next to each other. Each operating unit contains a spinning unit with a singling-out device having in its body a rotatably mounted combing roller. The combing roller is equipped on its circumferential surface with an operative coating. Around the combing roller there is, provided in the body of the singling-out device, a circumferential fibre channel. The coating's operative section extends in the sense of rotation of the combing roller from the mouth of the sliver feeding device to the supply channel that brings the singled-out fibres into the rotor. The operative section of the circumferential fibre channel has a mouth of a closable supply channel for pressure air.

BACKGROUND

At each yarn interruption on each spinning unit in the rotor spinning machines, the spinning process is to be restarted by inserting the yarn end into the rotor of the spinning unit during yarn rupture or during the tube substitution for a fully wound bobbin. The yarn end receives fibres deposited in a well-known manner on the collection surface of the rotor. Continuous spinning restarts by the following yarn draw-off. This whole cycle is called spinning-in.

Rotor spinning machines for open-end spinning can be divided into machines depending on the method by which underpressure is generated in the rotor. One machine has an active rotor fitted with vent holes for generating the underpressure in the rotor by its own revolving motion on one side. Alternatively, machines with a passive rotor may be provided in which the underpressure is generated by seating the rotor in an underpressure chamber connected with an underpressure source on one side. While there are some mutual differences in the spinning-in operation, each of these machines keep their respective combing roller in uninterrupted rotation while the sliver feed is stopped. The rotating combing roller releases fibres from the sliver end or also tears off or breaks off parts of the sliver. This process goes on for a time interval lasting up to the arrival of an attending device or of the operator.

If the spinning-in operation is carried out automatically or manually by the attending device on a fibre band made of a damaged sliver end, the piecer quality is poor and the number of failed spinning-in attempts is high. Poor quality piecer reduces the yarn usefulness for further processing in the textile industry such as in weaving. This is because it leads to ruptures of the yarn being processed or to aesthetic defects of final products.

Patent CZ 280036 G6 discloses a method of spinning-in yarn on rotor spinning machines in which the interruption of the spinning process is followed by the stop of the sliver feeding into the singling-out device. The combing roller continues rotating and the rotor is stopped at least for a cleaning period. At the restart of the rotor, the rotor receives back the yarn end which is brought into contact with the fibre band in the process of formation. Before the rotor starts and at the latest simultaneously with the beginning of the sliver feed, the surface of the combing roller is exposed to the action of pressure air. This air acts in the direction of the combing roller rotation between the place of inlet of the sliver to the combing roller and the beginning of the supply channel for feeding singled-out fibres to the rotor. In this way, sliver fibres and stuck impurities are removed from the operative surface of the combing roller. The pressure air supply is then stopped and the singled-out fibres are supplied into the rotor in a manner known in the art.

The CZ 280036 G6 patent also discloses a device for carrying out the method for rotor spinning machines with active or passive rotors fitted with an attending device. Rotatably mounted in the body of the singling-out device of the rotor spinning machine is a combing roller around whose cylindrical surface is fitted with an operative coating. A circumferential fibre channel is provided and communicates with a supply channel for feeding singled-out fibres to the rotor. Related to the combing roller is a sliver feed device that interrupts the circumferential fibre channel around the combing roller. The end of a closable pressure air supply channel is introduced into this fibre transport channel. The inner space of the channel is closed by a back valve which is on the outer side of the body of the singling-out device. The valve is adapted for connection to the pressure air supply provided on the attending device. At least the end part of the pressure air supply that serves for the connection to the back valve is adjustably mounted on the attending device.

The drawback of this solution consists in high requirements imposed upon the precision of the stop of the attending device in front of the operating unit of the rotor spinning machine. Equally high requirements are imposed on the precision of the construction and adjustment of the motion path of the pressure air supply. Both are necessary to ensure that the end part always comes to sit exactly on the back valve of the operating unit to be attended. Failing this, the spinning-in either fails to take place or leads to such a poor piecer quality which renders necessary a repetition of the spinning-in process.

The present invention aims to simplify the action of the attending device in restarting the spinning process on an operating unit of a rotor spinning machine. The pressure air action is maintained on the surface of the combing roller prior to the rotor start, and at the latest simultaneously with the start of the sliver supply channel and the termination of the action of the pressure air stream after the removal of the damaged and shortened fibres of the sliver end away from the spinning rotor area.

SUMMARY OF THE INVENTION

Features and advantages of the invention will be set forth in part in the following description or may be obvious from the description, or may be learned through practice of the invention.

One embodiment of the present invention provides for a rotor spinning machine that has a singling-out device which includes a body. The body defines a circumferential fibre channel and an auxiliary supply channel that is in communication with the circumferential fibre channel. The auxiliary supply channel may deliver cleaning pressurized air into the circumferential channel at selected times. A combing roller is rotatably mounted within the body. A closing device is in fluid communication with the auxiliary supply channel. An air pressure source is in fluid communication with the auxiliary supply channel through the closing device. Upon actuation of the closing device, it limits the pressurized air that is supplied to the circumferential fibre channel from the auxiliary supply channel. The air pressure source is in the rotor spinning machine and is in continuous communication with the closing device.

Also provided according to the present invention is a rotor spinning machine as previously discussed where the body defines a mouth for communication between the sliver feeding device and the circumferential fibre channel. The body defines a supply channel for communication between the circumferential fibre channel and a rotor. An auxiliary pressurized air supply channel is in communication with the circumferential fibre channel between the mouth and the supply channel. The combing roller may have an operative section on the circumferential surface of the combing roller.

The present invention also encompasses an embodiment of the rotor spinning machine as discussed above which further has a control unit that is used for controlling the closing device.

Another embodiment of the present invention exists in which the rotor spinning machine as discussed above has a closing device that is a valve.

The present invention also includes an embodiment of a rotor spinning machine as discussed above where a control unit may be in communication with an attending device. This communication occurs at least during the time period when the attending device is stopped in an attending position by an operating unit.

Alternatively, the present invention includes an embodiment of a rotor spinning machine as previously discussed where the air pressure source is in fluid communication with the closing device through a pressure hose.

Additionally, the present invention also includes an embodiment of a rotor spinning machine as previously discussed where the closing device has an electromagnetic valve.

Further embodiments are present and consist of combinations of the afore-mentioned features. Also, other embodiments are defined in the claims.

BRIEF DESCRIPTION OF THE DRAWINGS

Examples of an exemplary embodiment of the device according to the invention are schematically shown in the enclosed drawings in which.

DETAILED DESCRIPTION

Figure 1:
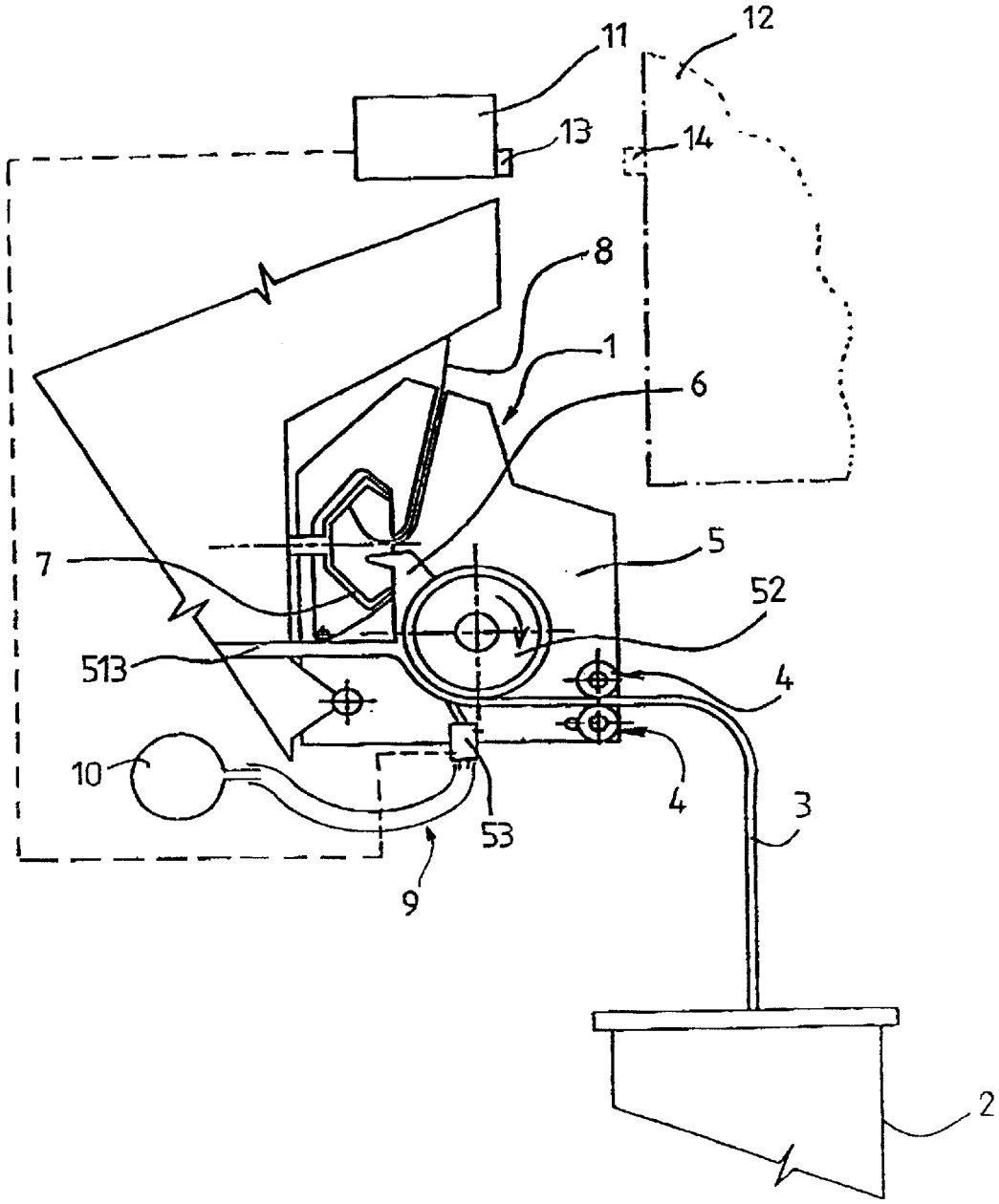
FIG. 1 is a view of the spinning unit in section.

Reference will now be made in detail to embodiments of the invention, examples of which are shown in the drawings. Each example is provided by way of explanation of the invention, and is not meant as a limitation of the invention. For example, features illustrated or described as part of one embodiment may be used on another embodiment to yield still a third embodiment. These and other modifications and variations are within the scope and spirit of the present invention The rotor spinning machine includes a plurality of operating units that are situated next to one another. Each of them produces yarn from a textile fibre sliver and winds the yard produced onto a bobbin.

The rotor spinning machine is made as a fully automatic or as a semi-automatic device. The present device is not applicable to spinning machines with exclusively manual control.

The fully automatic rotor spinning machine is fitted with an attending device adjustably situated along the operating units of the rotor spinning machine. The machine is fitted with means for carrying out attending operations on the operating unit when restarting the spinning and/or doffing fully wound bobbins and substituting empty tubes.

The semi-automatic rotor spinning machine is partly attended to manually and partly fitted with spinning-in automation means. Related to each operating unit of the semi-automatic spinning machine is a control unit. The control unit controls and/or collects data and may be connected with a sliver supply device, a yarn quality/presence monitor, a control means for releasing a yarn deflection member and letting the yarn end arrive at the collecting groove of the spinning rotor, and/or with control means for starting the yarn draw-off and winding. Other operations required for restarting the spinning on the operating unit are carried out manually. Therefore, during a yarn rupture the operator manually detects the yarn end on the bobbin, winds off and meters the required yarn length, cleans the spinning rotor, and leads the yarn to its preparatory spinning-in position in which the yarn rests on the deflecting means in which its end does not reach onto the collecting groove of the spinning rotor. At the end, the operator sends the command for initiating subsequent spinning-in steps.

Each operating unit includes a spinning unit 1 and a sliver can 2 seated thereunder and containing a sliver 3 led from it to a feeding device 4 of the spinning unit 1. The feeding device 4 is followed by a singling-out device 5 having related thereto a supply channel 6 of singled-out fibres leading into a rotor 7 made in a manner known in the art either as an active or as a passive rotor. The active rotor 7 shown in FIG. 2 has vent holes serving for generating underpressure. The passive rotor is made as a full-wall open rotary body without vent holes and seated in an underpressure chamber whose underpressure generates underpressure also in the inner space of the passive rotor.

The rotor 7 produces in a well-known manner yarn 8 which is by a draw-off device (not shown) delivered from the rotor 7 and by a well-known winding device (not shown) wound on a bobbin.

The singling-out device 5 includes a body 51 of the singling-out device 5 having seated therein a rotatably mounted combing roller 52. Combing roller 52 has a cylindrical circumferential surface fitted with an operative coating 521. Situated opposite the circumferential surface of the combing roller 52 is the mouth of the feeding device 4 of the sliver 3. Around the operative coating 521 of the combing roller 52 there is created a circumferential fibre channel 511 whose operative section extends in the direction of rotation of the combing roller 52 from the mouth of the feeding device 4 of the sliver 3 to the supply channel 6 for feeding singled-out fibres into the rotor 7. The operative section of the circumferential fibre channel 511 is followed by an impurity removal channel 512 provided in the body 51 of the singling-out device 5 in a well-known manner in such a way that it ends in an underpressure channel 513.

Figure 2:
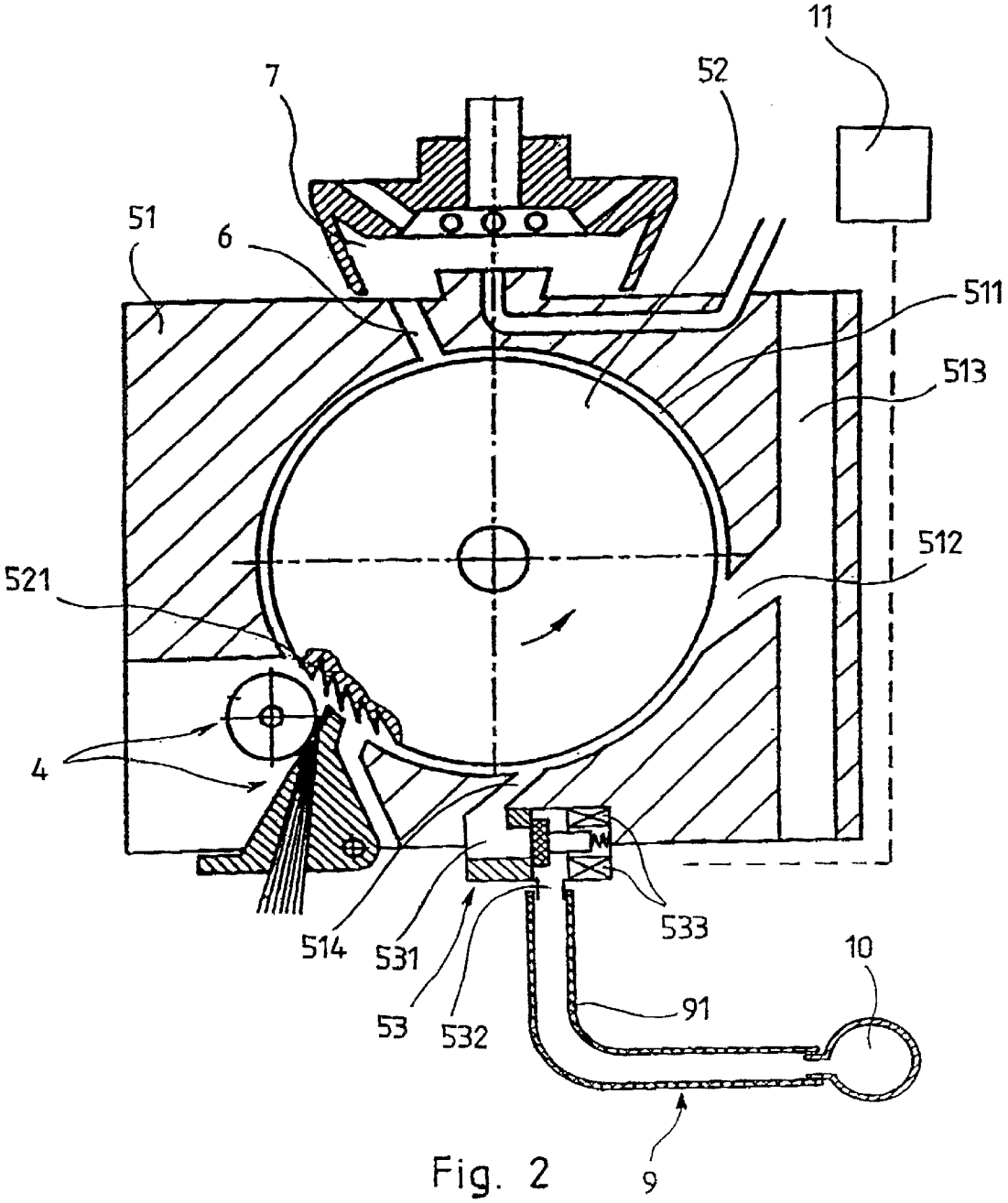
FIG. 2 a section of the singling-out device and of other parts of the spinning unit, and FIG. 3 a section of the pressure air closing means.
Figure 3:
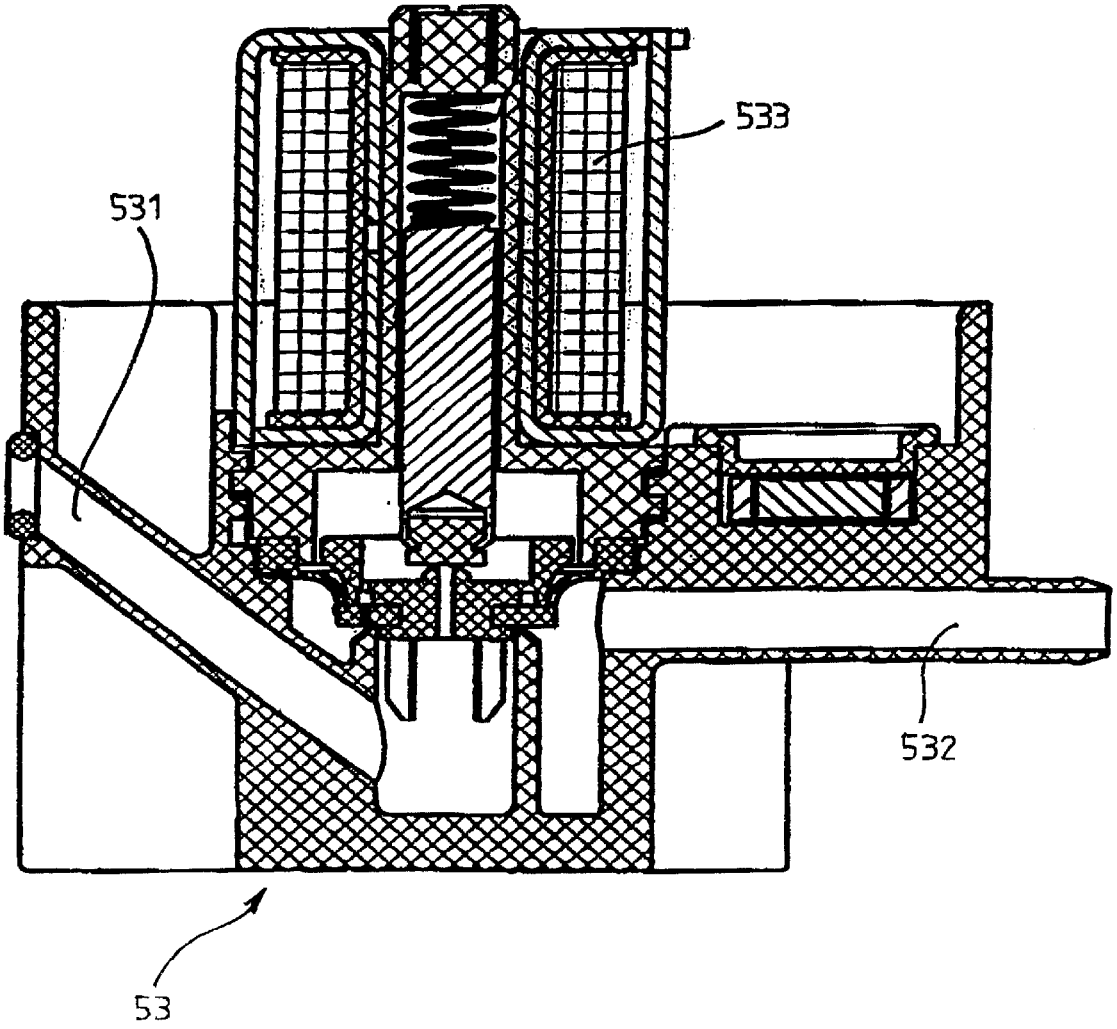

In the example of embodiment of the spinning machine with the active rotor shown in FIG. 2, an auxiliary supply channel 514 made in the body 51 of the singling-out device 5 ends in the operative section of the circumferential fibre channel 511, specifically, between the mouth of the feeding device 4 and the impurity removal channel 512. The inner space of the auxiliary supply channel 514 is connected with an outlet 531 of a closing means 53 of pressure air mounted in or on the body 51 of the singling-out device 5, and is made for instance as an electromagnetic valve. The closing means 53 is fitted with a control member 533 interconnected with a control unit 11. An inlet 532 of the closing means 53 is connected by pressure air pipe 9 with a pressure air source 10 situated on the spinning machine. In the exemplary embodiment shown, the pressure air source 10 is made as a pressure pipeline situated along the operating units throughout the length of the rotor spinning machine. In a double-sided rotor spinning machine, the pressure pipeline can be either common to both machine sides or a separate pressure pipeline can be used for each side. The pressure air pipe 9 is at least in a part elastic, consisting of a pressure hose 91. This permits the spinning unit 1 to be tilted out.

In the example shown of the embodiment of the machine, the closing means 53 includes an electromagnetic valve whose control coil is connected with the control unit 11.

The closing means 53 can also be a pneumatic valve whose control member is connected with the control unit 11 of the operating unit of the spinning machine.

The embodiment shown in FIG. 2 can be applied also to passive rotors seated in the underpressure chamber.

The auxiliary supply channel 514 leads into the circumferential fibre channel 511 in the form of one hole or of a plurality of small-diameter holes, or also of one nozzle or of a plurality of nozzles. The objective of this arrangement consists in obtaining the required outlet velocity of air streaming from the auxiliary supply channel 514 into the circumferential fibre channel 511. The air stream coming from the auxiliary supply channel 514 into the circumferential fibre channel 511 is directed on the operative coating 521 of the combing roller 52 in the direction of rotation of the combing roller 52. The most advantageous direction of this air stream is in the direction of a tangent or secant of the operative coating 521 of the combing roller 52.

In the embodiment of the rotor spinning machine with the passive rotor situated in the underpressure chamber, the auxiliary supply channel 514 can lead into the operative section of the circumferential fibre channel 511 in the direction of rotation of the combing roller 52. This entry point may be behind the impurity removal channel 512, that is between this channel 512 and the supply channel 6 for feeding singled-out fibres into the passive rotor. The proper formation of the auxiliary supply channel 514 and its connection with the closing means 53, with the pressure air pipe 9 and with the pressure air source 10 is the same as in the preceding exemplary embodiments.

In the automatic rotor spinning device, the attending device 12 is fitted with a well-known means (not shown) for detecting the yam end on the bobbin, unwinding, and metering the yarn end required for spinning-in. Means may also be provided for opening the spinning unit, cleaning the spinning rotor, and introducing the yarn end into the delivery tube into the preparatory spinning-in position in which the yarn end does not reach as far as into contact with the collecting groove of the spinning rotor. Before the spinning-in, the yarn is held in the means of the attending device from which it is continuously released during the spinning-in operation.

The attending device 12 and each operating unit of the rotor spinning machine are fitted with communication means 13, 14 for mutual communication at least for the control of the control member of the closing means 53. This control member may be the coil of an electromagnetic valve. This communication can be carried out either via the control unit 11 of the operating unit, or directly between the attending device 12 and the control member 533 of the closing means 53.

An attending device 12 may restart the spinning on an operating unit of the rotor spinning machine. The attending device 12 carries out all steps required to prepare the yarn 8 and the spinning rotor 7 for spinning-in. During the closing of the spinning unit 1 and before the beginning of the rotary motion of the spinning rotor 7, the attending device 12 sends a command to open the closing means 53 of pressure air of the attended operating unit. This is done so that pressure air begins to stream into the auxiliary supply channel 514 and into the operative section of the circumferential section 511 of the singling-out device 5. This carries fibres and impurities from the surface of the combing roller 52 into the impurity removal channel 512. Following this, the attending device 12 sends a command for starting the feed of the sliver 3 so that the operative section of the circumferential fibre channel 511 receives fibres. The pressure air stream pushes the fibers from the auxiliary supply channel 514 and leads them away from the spinning rotor 7 and into the impurity removal channel 512. After a predetermined interval during which all damaged sliver fibres are deflected away from the spinning rotor, the attending device 12 gives a command or signal to close the closing means 53 and thus stops the pressure air supply to the auxiliary supply channel 514. Therefore, the fibres situated in the operative section of the circumferential fibre channel 511 are led into the spinning rotor 7 in whose widest section they form a fibre band. The attending device 12 gives a command to let the spinning-in end of the yarn 8 enter the spinning rotor 7 where the spinning-in end of the yarn 8 is joined by the fibers of the fibre band. A command coming from the attending device 12 then starts the draw-off and the winding of the yarn 8 and thus resumes the spinning process on the operating unit being attended. The attending device 12 then moves to a next operating unit in need of attendance.

In semi-automatic rotor spinning machines, the cleaning of the spinning rotor 7 and the preparation of the yarn 8 for spinning-in is carried out manually by the operator. The operator gives a command to start further spinning-in steps to be carried out by the operating unit after the closing of the spinning unit 1 and inserting the spinning-in end of the yarn 8 into the delivery tube. The command to open the closing means 53 for pressure air supply into the circumferential fibre channel 511 is given either by the operator or by the control unit 11 controlling all further means for the operating unit during the spinning-in.

It should be understood that the invention includes various modifications that can be made to the embodiments of the spinning machine described herein as come within the scope of the appended claims and their equivalents.

What is claimed is:

1. A rotor spinning machine comprising:

a singling-out device having a body, said body defining a circumferential fiber channel and an auxiliary supply channel in communication with said circumferential fiber channel for delivering cleaning pressurized air into said circumferential channel at selected times;

a combing roller rotatably mounted within said body;

a closing device in fluid communication with said auxiliary supply channel;

an air pressure source in fluid communication with said auxiliary supply channel through said closing device, upon actuation thereof said closing device limiting the pressurized air being supplied to said circumferential fiber channel from said auxiliary supply channel, said air pressure source is in said rotor spinning machine and is in continuous communication with said closing device.

2. The rotor spinning machine of claim 1, wherein:

said body defines a mouth for communication between a sliver feeding device and said circumferential fiber channel;

said body defines a supply channel in communication with said circumferential fiber channel, singled-out fibers moving through said supply channel to a rotor spinning device; and said combing roller has an operative section on the circumferential surface of said combing roller, said operative section oriented in the direction of rotation of said combing roller from said mouth to said supply channel, said auxiliary supply channel opening into said circumferential fiber channel in said operative section.

3. The rotor spinning machine of claim 1, further comprising a control unit for controlling said closing device.

4. The rotor spinning machine of claim 3, wherein said control unit is in communication with an attending device at least during the time period when the attending device is stopped in an attending position by an operating unit.

5. The rotor spinning machine of claim 3, wherein said control unit is coupled with at least one manual start which effects the manual start of the spinning-in of the operating unit.

6. The rotor spinning machine of claim 1, wherein said closing device is a valve.

7. The rotor spinning machine of claim 1, wherein said air pressure source is in fluid communication with said closing device via a pressure hose.

8. The rotor spinning machine of claim 1, wherein said air pressure source is a compressed air pipeline situated along the length of said machine.

9. The rotor spinning machine of claim 1, wherein said closing device has an electromagnetic valve.

10. A rotor spinning machine comprising:

a singling-out device having a body, said body defining a circumferential fiber channel, said body defining a mouth for communication between a sliver feeding device and said circumferential fiber channel, said body defining a supply channel for communication between said circumferential fiber channel and a rotor, an auxiliary pressurized air supply channel is in communication with said circumferential fiber channel between said mouth and said supply channel;

a combing roller rotatably mounted within said body, said combing roller having an operative section on the circumferential surface of said combing roller;

an actuatable closing device in fluid communication with said auxiliary supply channel; and an air pressure source in fluid communication with said auxiliary supply channel through said closing device, said closing device limiting the air supplied to said circumferential fiber channel from said auxiliary supply channel upon actuation thereof, said air pressure source is in said rotor spinning machine and is in continuous communication with said closing device.

11. The rotor spinning machine of claim 10, further comprising a control unit for controlling said closing device.

12. The rotor spinning machine of claim 11, wherein said control unit is in communication with an attending device at least during the time period when the attending device is stopped in an attending position by an operating unit.

13. The rotor spinning machine of claim 11, wherein said control unit is coupled with at least one manual start which effects the manual start of the spinning-in of the operating unit.

14. The rotor spinning machine of claim 10, wherein said closing device is a valve.

15. The rotor spinning machine of claim 10, wherein said air pressure source is in fluid communication with said closing device via a pressure hose.

16. The rotor spinning machine of claim 10, wherein said air pressure source is a compressed air pipeline situated along the length of said machine.

17. The rotor spinning machine of claim 10, wherein said closing device has an electromagnetic valve.

* * * * *